US008297607B2

(12) United States Patent
Yahata et al.

(10) Patent No.: US 8,297,607 B2
(45) Date of Patent: Oct. 30, 2012

(54) SHEET PROCESSING APPARATUS, IMAGE FORMING SYSTEM AND SHEET PROCESSING METHOD

(75) Inventors: Isao Yahata, Shizuoka-ken (JP); Hiroyuki Taguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/191,358

(22) Filed: Jul. 26, 2011

(65) Prior Publication Data

US 2012/0025439 A1 Feb. 2, 2012

Related U.S. Application Data

(60) Provisional application No. 61/368,595, filed on Jul. 28, 2010, provisional application No. 61/368,587, filed on Jul. 28, 2010.

(30) Foreign Application Priority Data

Oct. 14, 2010 (JP) ..... P2010-231310

(51) Int. Cl.
*B65H 37/06* (2006.01)

(52) U.S. Cl. ..... 270/32; 493/444; 493/445

(58) Field of Classification Search ..... 270/32, 270/45; 493/444, 445
See application file for complete search history.

(56) References Cited

U.S. PATENT DOCUMENTS

| | | | | |
|---|---|---|---|---|
| 7,744,073 | B2 * | 6/2010 | Iguchi et al. | 270/32 |
| 7,850,156 | B2 * | 12/2010 | Iguchi et al. | 270/37 |
| 7,922,160 | B2 * | 4/2011 | Iguchi et al. | 270/45 |
| 7,922,161 | B2 | 4/2011 | Iguchi et al. | |
| 7,950,643 | B2 * | 5/2011 | Kawaguchi | 270/37 |
| 7,950,644 | B2 * | 5/2011 | Iguchi et al. | 270/45 |
| 7,997,572 | B2 * | 8/2011 | Iguchi et al. | 270/45 |
| 8,083,218 | B2 * | 12/2011 | Dobashi et al. | 270/45 |
| 8,146,905 | B2 * | 4/2012 | Kawaguchi | 270/37 |
| 8,162,304 | B2 * | 4/2012 | Iguchi et al. | 270/45 |
| 2012/0027427 | A1 * | 2/2012 | Taki | 399/21 |

FOREIGN PATENT DOCUMENTS

| | | |
|---|---|---|
| JP | 3732812 | 1/2006 |
| JP | 3746472 | 2/2006 |

OTHER PUBLICATIONS

U.S. Appl. No. 13/040,508, Iguchi, et al.

* cited by examiner

*Primary Examiner* — Patrick Mackey
(74) *Attorney, Agent, or Firm* — Patterson & Sheridan, LLP

(57) ABSTRACT

According to one embodiment, a sheet processing apparatus includes a reinforce roller to further reinforce the fold of a sheet which has been folded by a fold roller pair, a support portion to move the reinforce roller in a direction perpendicular to a sheet conveying direction, a sensor to sense a position of the support portion, a distance sensing portion to sense a distance to a first position and a distance to a second position from a stop position of the support portion, when the sensor senses an abnormal stop of the support portion, and a control unit to compare the distance to the first position and the distance to the second position sensed by the distance sensing portion and to control the support portion to move in a direction where a moving distance is shorter.

18 Claims, 15 Drawing Sheets

SHEET PROCESSING APPARATUS, IMAGE FORMING SYSTEM AND SHEET PROCESSING METHOD

CROSS-REFERENCE TO RELATED APPLICATION

This application is based upon and claims the benefit of priority from the prior U.S. Patent Application Nos. 61/368,595, filed on Jul. 28, 2010 and 61/368,587, filed on Jul. 28, 2010, the entire contents of which are incorporated herein by reference.

This application is also based upon and claims the benefit of priority from Japanese Patent Application No. 2010-231310, filed on Oct. 14, 2010, the entire contents of which are incorporated herein by reference.

FIELD

Exemplary embodiments described herein relate to a sheet processing apparatus, an image forming system and a sheet processing method provided with processing functions, such as, sorting, stapling and reinforcing functions.

BACKGROUND

With respect to the fold of a sheet at the time of reinforcing, sheet processing apparatuses are known which reinforces the fold of a sheet with a reinforce roller unit having a roller separate from a fold roller pair. However in case that the reinforce roller is distant from a home position when an abnormality is sensed, there is a problem that the moving distance of the reinforce roller to the home position is long and thereby a long time is required.

DETAILED DESCRIPTION

In general, according to one embodiment, there is provided a sheet processing apparatus including: a fold roller pair to fold a sheet being pushed into a nip thereof, a reinforce roller to reinforce a fold of the sheet folded by the fold roller pair; a support portion to move the reinforce roller in a direction perpendicular to a sheet conveying direction; a sensor to sense a position of the support portion; a distance sensing portion to sense a distance to a first position and a distance to a second position from a stop position of the support portion, when the sensor senses an abnormal stop of the support portion; and a control unit to compare the distance to the first position and the distance to the second position sensed by the distance sensing portion and to control the support portion to move in a direction where a moving distance is shorter.

Hereinafter, an embodiment of a sheet processing apparatus will be described with reference to the accompanied drawings.

First Embodiment

At the time of the jam, an embodiment compares a distance to a first position and a distance to a second position from a stop position of a reinforce roller for a width of a sheet during a reinforcing operation, and causes the reinforce roller to move in a direction where the moving distance is shorter.

Figure 1:
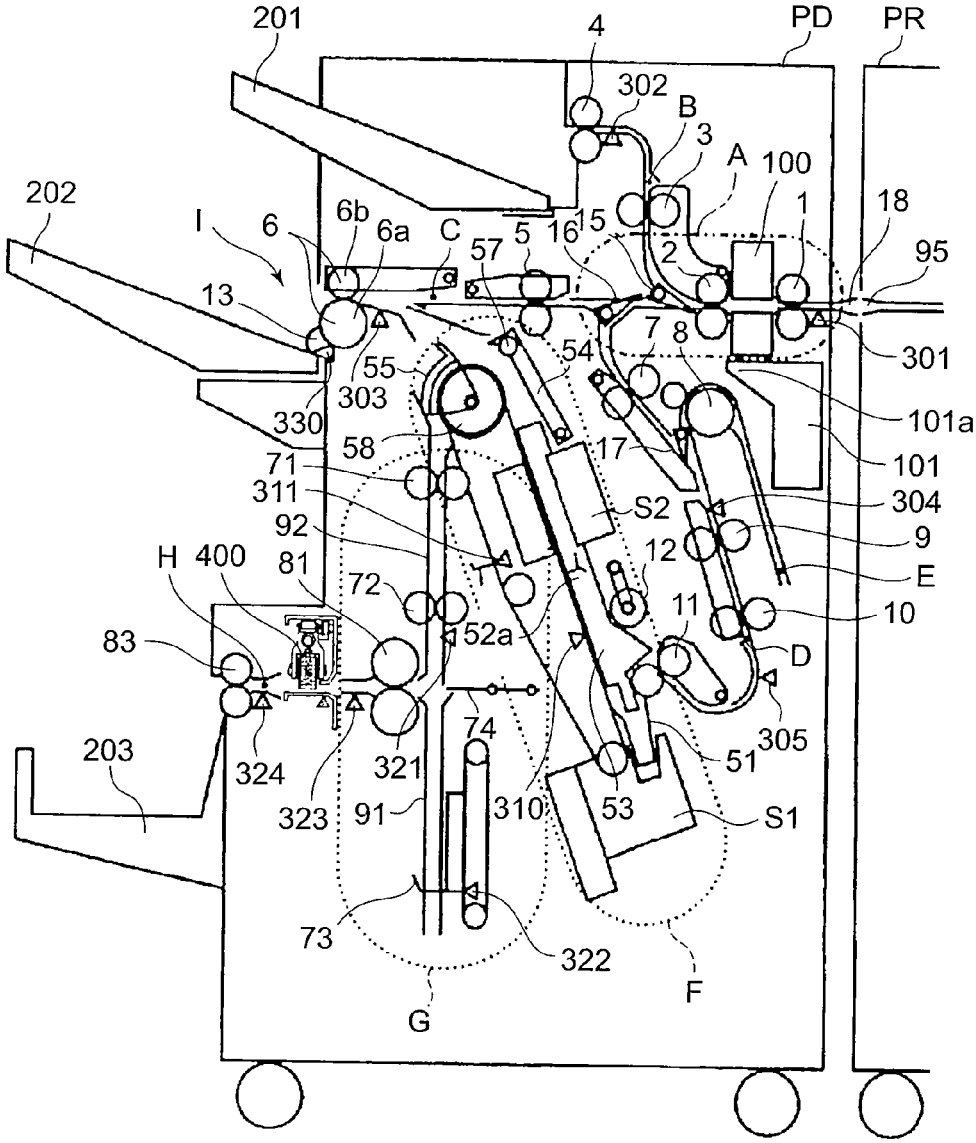
FIG. 1 is a construction view of a finisher in a first embodiment.

FIG. 1 shows a construction of an image forming system composed of a finisher PD as a sheet processing apparatus of a first embodiment and an image forming apparatus PR. FIG. 1 shows the whole of the finisher PD and a part of the image forming apparatus PR.

In FIG. 1, the finisher PD is fixed to the image forming apparatus PR, and a recording medium discharged from a sheet discharge port of the image forming apparatus PR is lead to an inlet 18 of the finisher PD. Here, the recording medium is a sheet. A sheet passes through a path A having finishing means for finishing the sheet, and then is sorted by path selectors 15, 16 into any one of a path B for leading the sheet to an upper tray 201, a path C for leading the sheet to a shift tray 202, a path D for leading the sheet to a processing tray F (hereinafter referred to also as a staple tray) which aligns, staples or otherwise processes the sheet or sheets.

The sheets led to the staple tray F through the paths A and D and then aligned and stapled in the staple tray F are sorted by a guide plate 54 and a movable guide 55 that composes deflecting means into the path C for leading the sheet to the shift tray 202 and a processing tray G (hereinafter referred to also as a fold processing tray) which folds or otherwise processes the sheets. The sheets which have been folded or otherwise processed in the fold processing tray G are further strongly folded by a reinforce roller unit 400, and then are lead to a lower tray 203 through a path H. In addition, a path selector 17 is arranged in the path D, and is kept in the state shown in FIG. 1 by a low load spring. After the back end of the sheet passes through the path selector 17, at least a conveying roller 9 out of the conveying rollers 9, 10 and a staple outlet roller 11, and a refeed roller 8 are rotated in the reverse direction to thereby lead the back end thereof to a prestacking portion E and to cause the sheet to stay there, and the sheet is conveyed together with the next sheet superposed thereon. Such an operation like this is repeated and thereby two or more sheets can also be conveyed in the superposed state.

On the path A which is mutual to the paths B, C, D, an inlet sensor 301 to sense the sheet received from the image forming apparatus PR is arranged at the upstream side, and at the down stream side thereof an input roller pair 1, a punch unit 100, a waste hopper 101, a conveying roller pair 2, the path selectors 15, 16 are sequentially arranged. The path selectors 15, 16 are maintained in the state shown in FIG. 1 by the springs, and when their solenoids are turned ON, the path selector 15 rotates upward and the path selector 16 rotates downward to thereby sort the sheet into one of the paths B, C, D.

The finisher PD selectively performs punching (the punch unit 100), jogging and edge stapling (jogger fences 53 and an edge stapler S1), jogging and center stapling (jogger fences 53 and center staplers S2), sorting (the shift tray 202) or center folding (a fold plate 74, a fold roller pair 81 and the reinforce roller unit 400) for a sheet or sheets.

Figure 2:
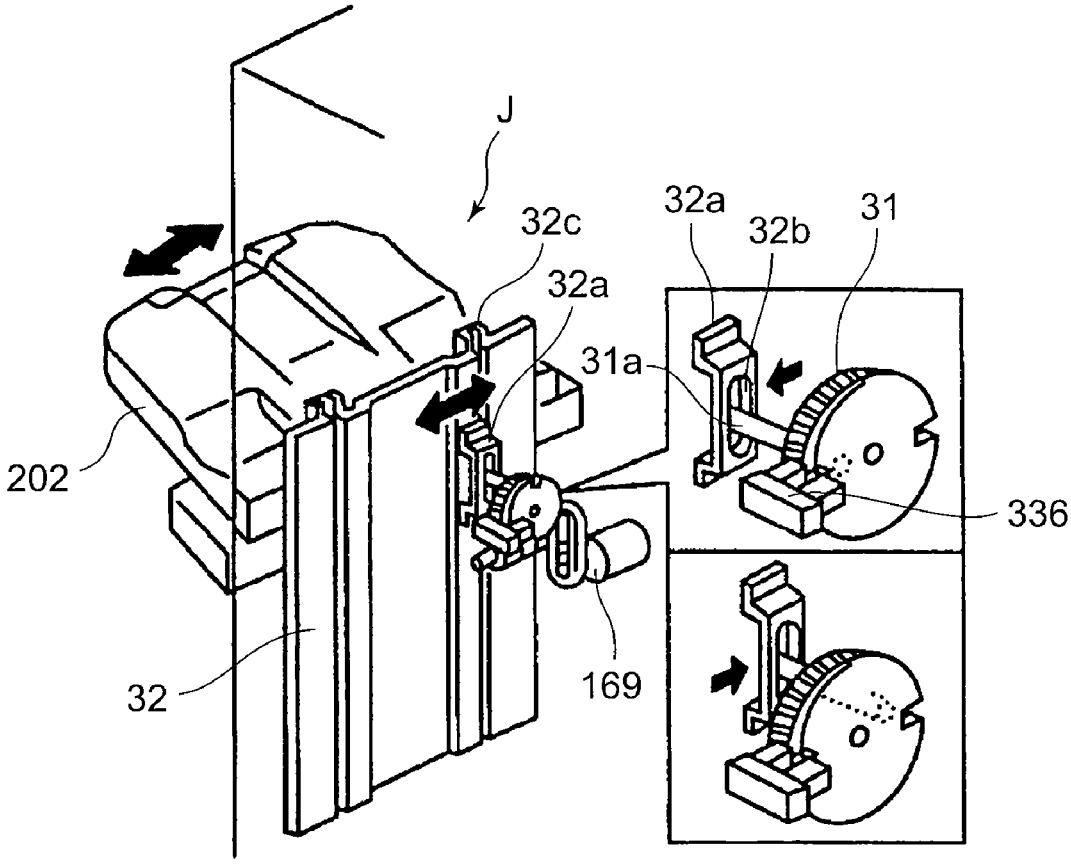
FIG. 2 is a perspective view showing a shifting mechanism in the first embodiment.
Figure 3:
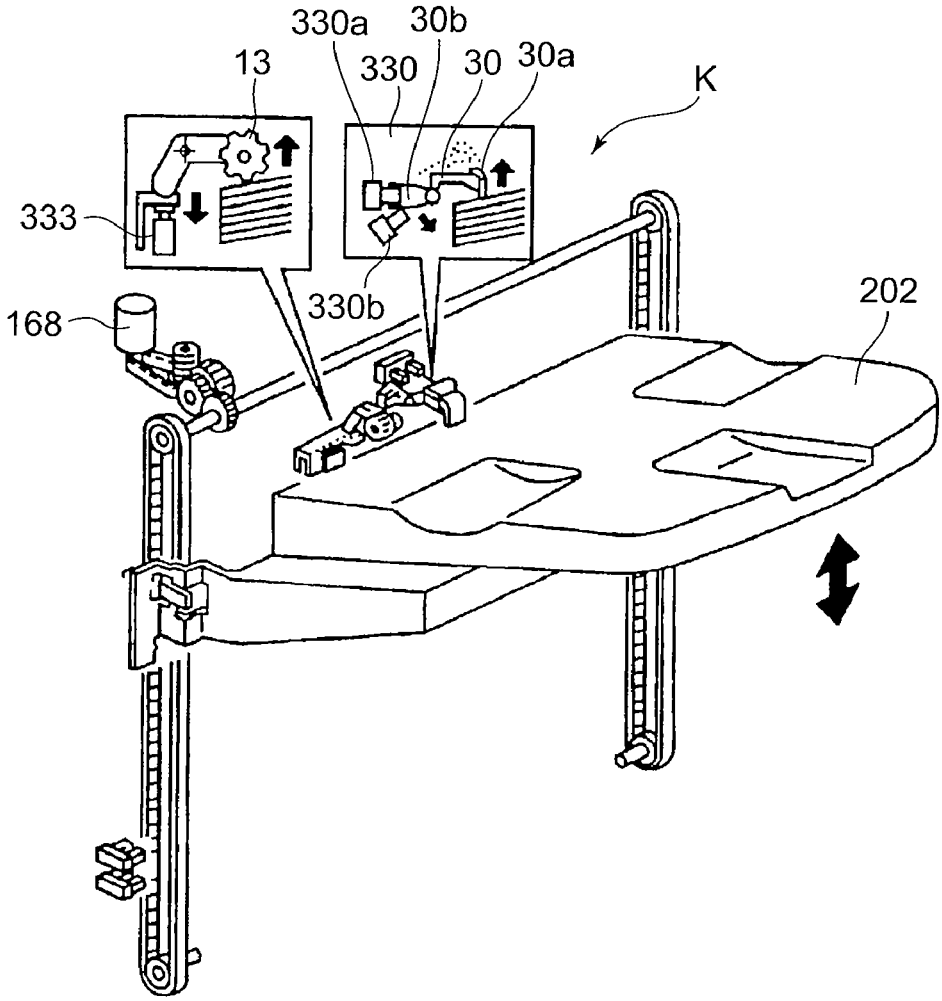
FIG. 3 is a perspective view showing a shift tray elevating mechanism in the first embodiment.

A shift tray outlet section I which is located at the most downstream position of the finisher PD includes shift outlet rollers 6, a return roller 13, a sheet surface sensor 330, the shift tray 202, a shifting mechanism J shown in FIG. 2 and a shift tray elevating mechanism K shown in FIG. 3. FIG. 2 is an enlarged perspective view of the main portion indicating the shifting mechanism J, and FIG. 3 is an enlarged perspective view of the main portion of the shift tray elevating mechanism K.

In FIGS. 1 and 3, the return roller 13 contacts a sheet discharged from the shift outlet rollers 6 and causes the back end of the sheet to abut against an end fence 32 shown in FIG. 2 for thereby aligning it. The return roller 13 is caused to be rotated by the rotation force of the shift outlet rollers 6. A limit switch 333 is arranged in the vicinity of the return roller 13, and when the shift tray 202 is lifted and raises the return roller 13, the limit switch 333 turns on to cause a tray motor 168 to stop rotating. This prevents the shift tray 202 from overrunning. Furthermore, as shown in FIG. 1, the sheet surface sensor 330 is provided as a sheet surface sensing means which senses a sheet surface position of a sheet or that of a sheet stack discharged out on the shift tray 202.

As shown in FIG. 3, the sheet surface censor 330 has a lever 30, a sheet surface sensor 330*a* (for stapling use) and a sheet surface sensor 330*b* (for non-stapling use). The lever 30 rotates around its shaft portion and has a contact end 30*a* which makes contact with the top of the back end of a sheet loaded on the shift tray 202 and a sectorial interrupter 30*b*.

When the sheet surface sensor 330*a* (for stapling use) and the sheet surface sensor 330*b* (for non-stapling use) sense that sheets are stacked on the shift tray 202 to a prescribed height, the tray motor 168 is driven to lower the shift tray 202 by a prescribed amount. The sheet surface position of the sheet stack on the shift tray 202 is therefore maintained at a substantially constant height.

Figure 4:
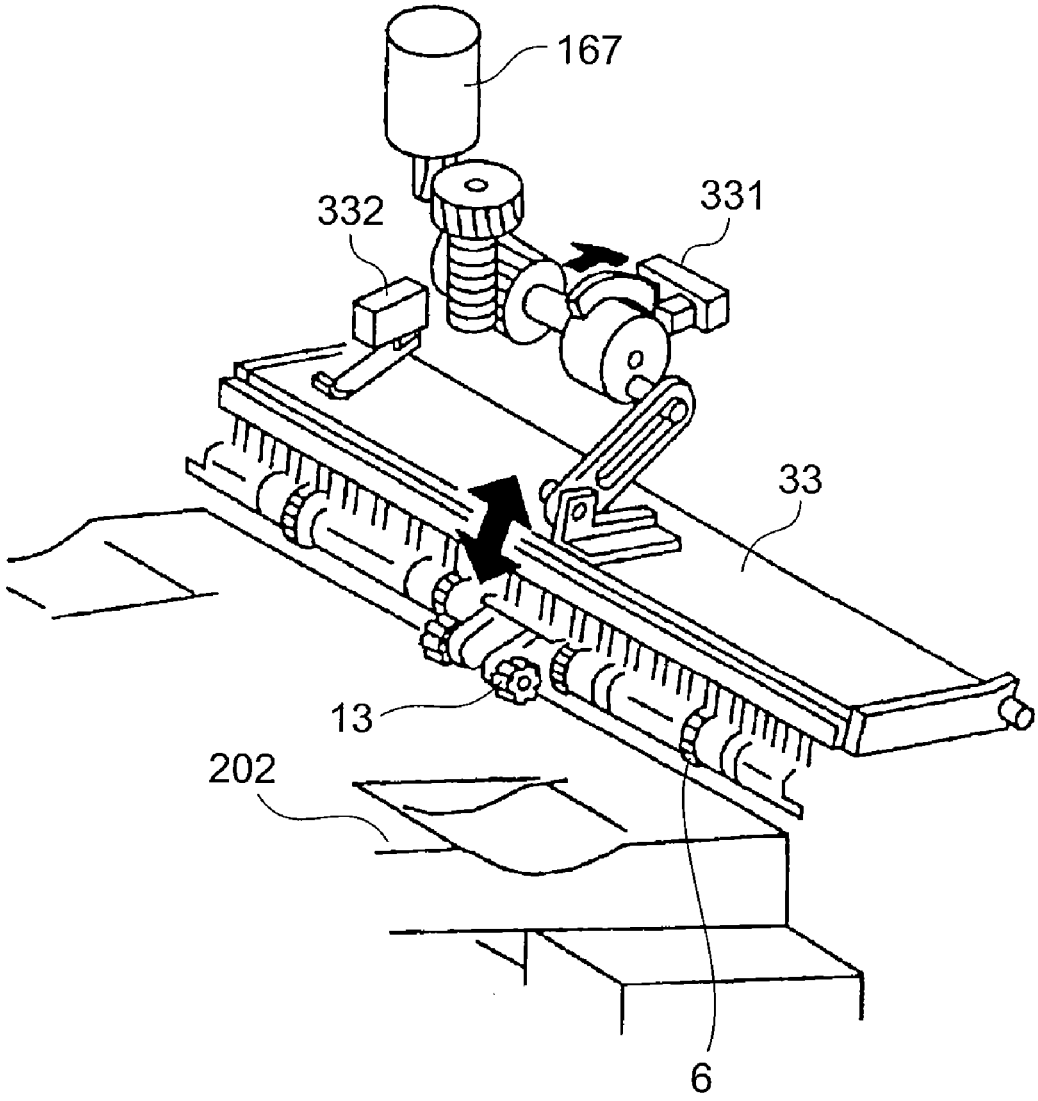
FIG. 4 is a perspective view showing an outlet section to the shift tray in the first embodiment.

FIG. 4 is a perspective view showing a construction of the outlet section I to the shift tray 202.

In FIGS. 1 and 4, the shift outlet roller 6 has a drive roller 6*a* and a driven roller 6*b*. The driven roller 6*b* is supported at its upstream side in the sheet discharge direction and is supported swingably in the up-and-down direction, and is rotatably supported to the free end of a guide plate 33. The driven roller 6*b* contacts the drive roller 6*a* due to its own weight or a biasing force, and a sheet is nipped between both the rollers 6*a*, 6*b* and is discharged.

When a stapled sheet stack is to be discharged, the guide plate 33 is lifted upward and then lowered at a prescribed timing. This timing is determined on the basis of a sensing signal of a shift outlet sensor 303. Its stop position is determined on the basis of a sensing signal of a guide plate sensor 331, and the guide plate 33 is driven by a guide plate motor 167. In addition, the guide plate motor 167 is drive controlled in accordance with the ON/OFF state of a limit switch 332.

A construction of the staple tray F for stapling will be described.

Figure 5:
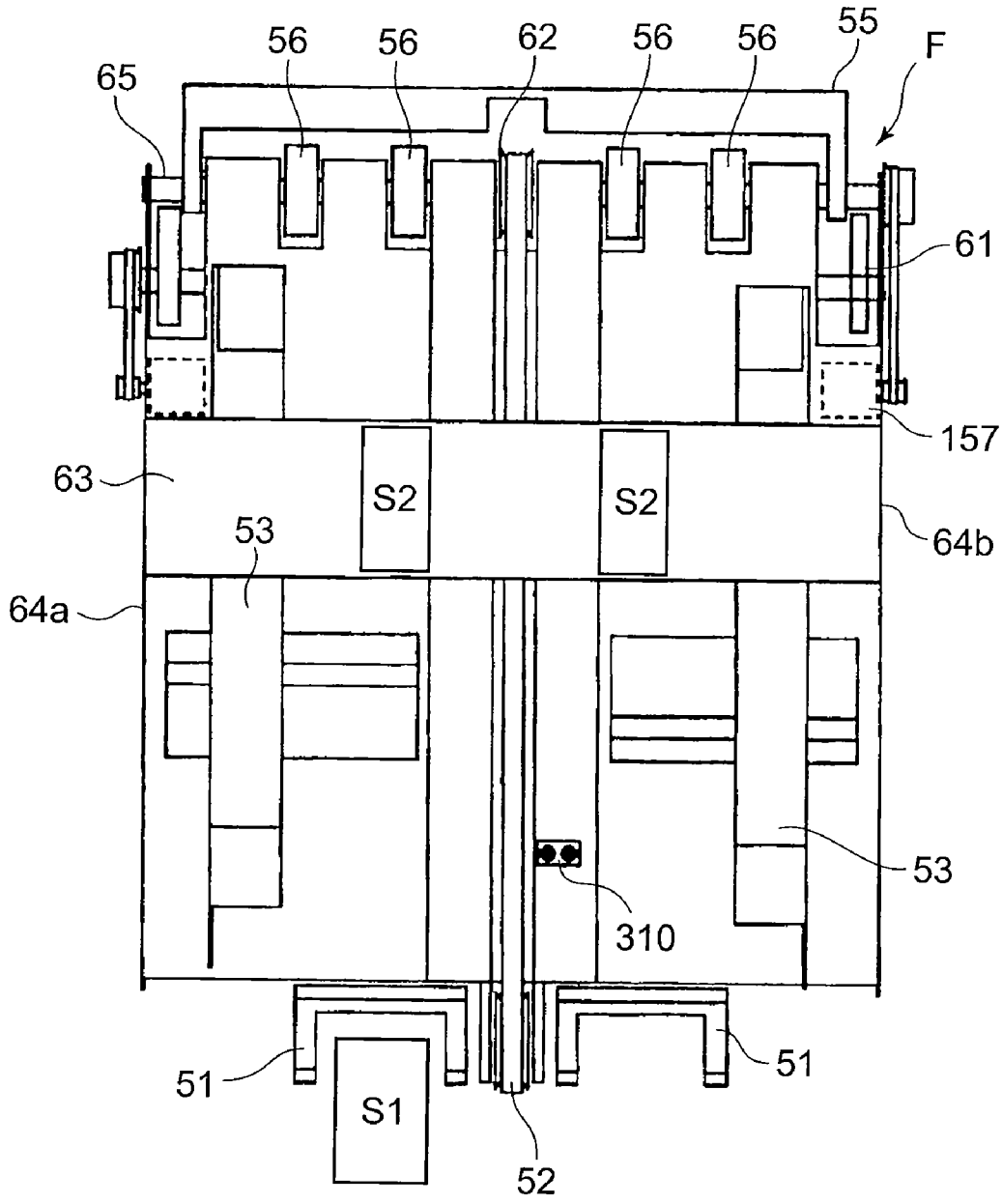
FIG. 5 is a plan view of a staple processing tray in the first embodiment as seen from a direction perpendicular to a sheet conveying plane
Figure 6:
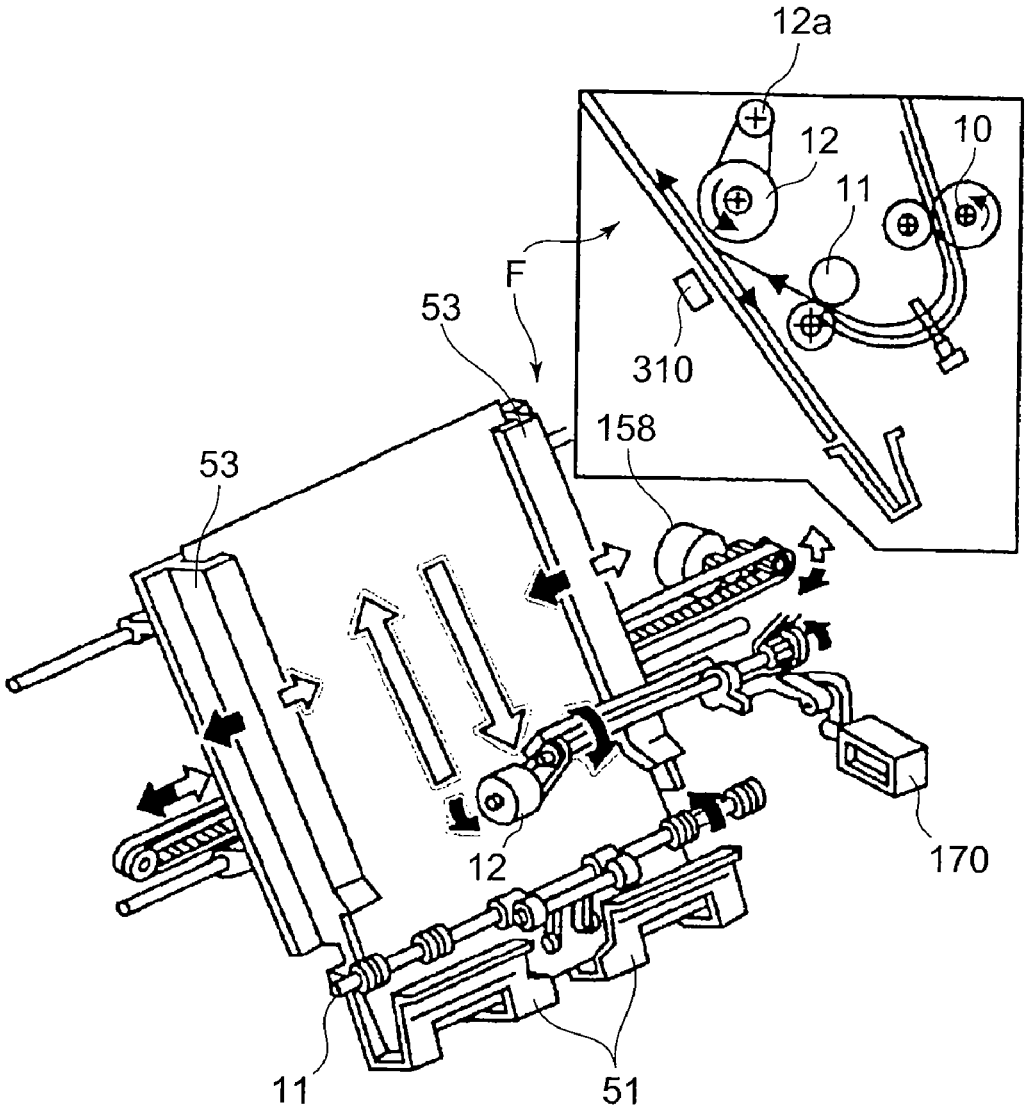
FIG. 6 is a perspective view showing the staple processing tray and its drive mechanism in the first embodiment.
Figure 7:
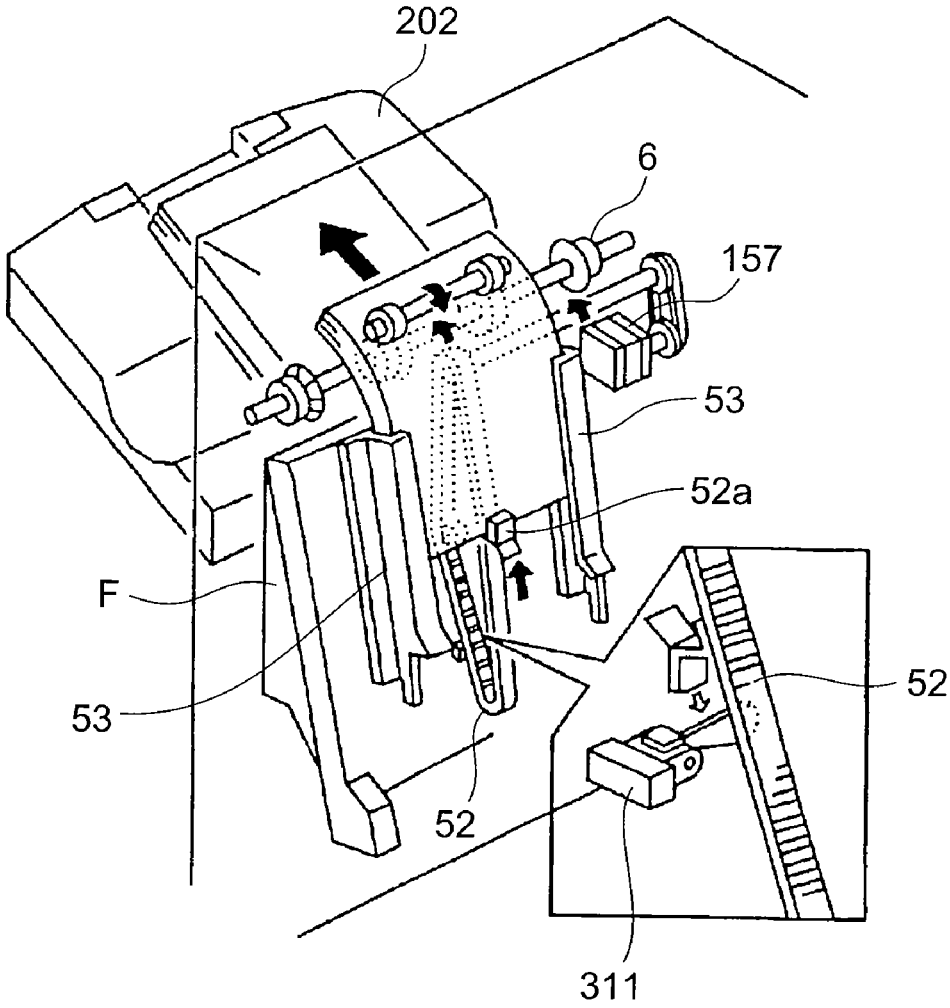
FIG. 7 is a perspective view showing a discharge mechanism of a sheet stack in the first embodiment.

FIG. 5 is a plan view of the staple tray F as seen from the direction perpendicular to the sheet conveying plane, FIG. 6 is a perspective view showing the staple tray F and its driving mechanism, and FIG. 7 is a perspective view showing a sheet stack discharging mechanism. As shown in FIG. 6, firstly sheets which are led by the staple outlet roller 11 to the staple tray F are sequentially stacked on the staple tray F. At this instant, a knock roller 12 aligns every sheet in the longitudinal direction (a sheet conveying direction), while jogger fences 53 aligns the sheet in the lateral direction (a direction perpendicular to the sheet conveying direction—sometimes referred to as a sheet width direction). Between consecutive jobs, i.e., during an interval between the last sheet of a sheet stack and the first sheet of the next sheet stack, an edge stapler S1 is driven by a staple signal from a control unit to thereby perform a stapling operation. The sheet stack which has been stapled is immediately conveyed to the shift outlet roller 6 by a discharge belt 52 with hooks 52*a* and is discharged to the shift tray 202 which is set at a receiving position.

As shown in FIG. 7, an HP sensor 311 senses the hook 52*a* of the discharge belt 52 brought to its home position. The HP sensor 311 is turned ON/OFF by the hook 52*a*. Two hooks 52*a* are arranged at spaced face-to-face positions on the outer circumference of the discharge belt 52, and alternately move and convey the sheet stacks housed on the staple tray F. The discharge belt 52 can be rotated in the reverse direction such that one hook 52*a* held in a stand-by position so as to move the sheet stack and the back of the other hook 52*a* at the opposite side align the leading end of the sheet stack housed in the staple tray F in the sheet conveying direction, as needed. The hook 52*a* function as aligning means of the sheet stack in the sheet conveying direction at the same time.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. The discharge rollers 56 are mounted on the discharge shaft 65 in a symmetrical arrangement. The discharge rollers 56 rotate at a higher peripheral speed than the discharge belt 52.

As shown in FIG. 6, a solenoid 170 causes the knock roller 12 to move about a fulcrum 12*a* in a pendulum fashion, so that the knock roller 12 intermittently acts on the sheets transferred to the staple tray F and causes the sheets to abut against rear fences 51. In addition, the knock roller 12 rotates counterclockwise. The jogger fences 53 are driven by a jogger motor 158 rotatable in the forward and reverse directions via a timing belt, and move back and forth in the sheet width direction.

Figure 8:
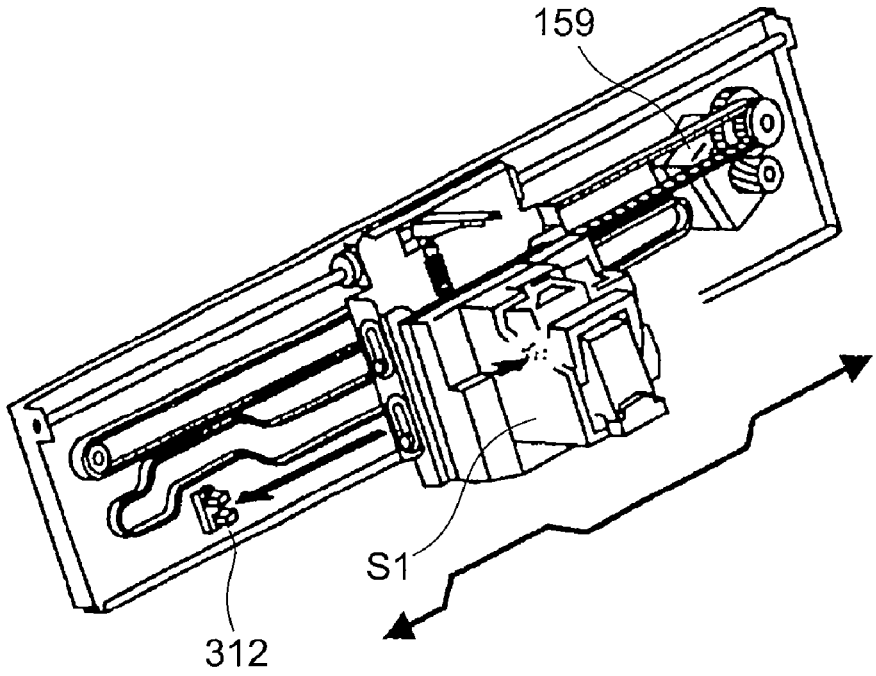
FIG. 8 is a perspective view showing an edge stapler and its moving mechanism in the first embodiment.
Figure 9:
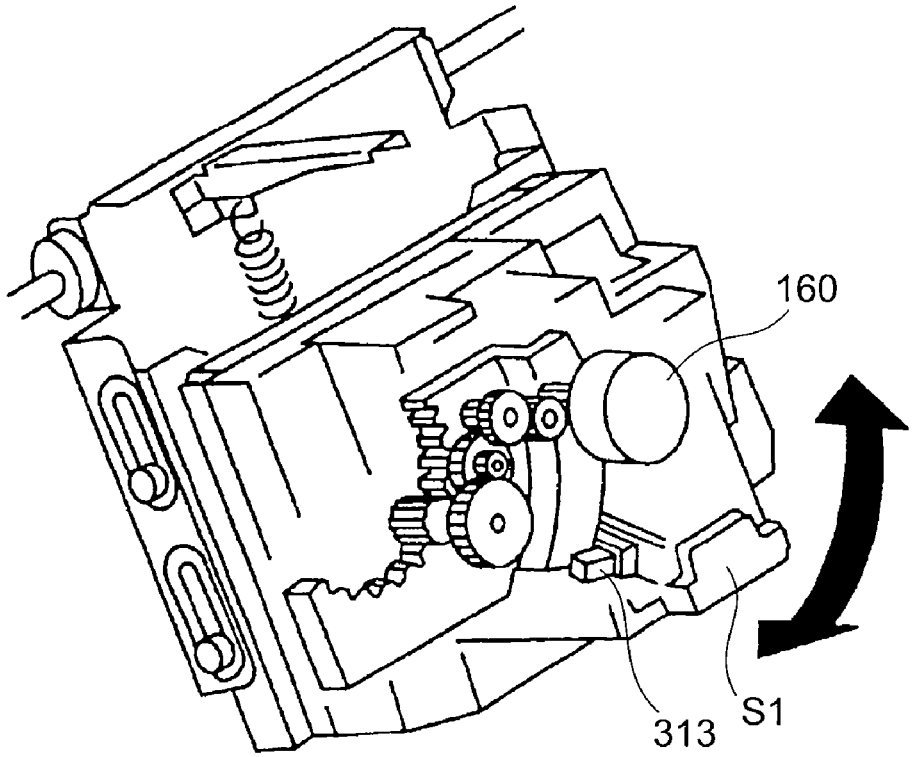
FIG. 9 is a perspective view showing an obliquely rotating mechanism of the stapler in the first embodiment.

In FIG. 8, the edge stapler S1 is driven by a stapler motor 159 which is rotatable in the forward and reverse directions via a timing belt, and moves in the sheet width direction in order to staple a sheet stack at a prescribed position of the sheet end portion. A stapler HP sensor 312 to sense the home position of the edge stapler S1 is provided at one end of the movable range of the edge stapler S1, and the stapling position in the sheet width direction is controlled in terms of the displacement of the edge stapler S1 from the home position. As shown in the perspective view of FIG. 9, the edge stapler S1 is constructed so that a striking angle of a staple can be selectively set in parallel to or obliquely to the edge portion of the sheet, and so that only the stapling mechanism portion of the edge stapler S1 at the home position is made rotatable by a prescribed angle obliquely so as to replace staples easily. The edge stapler S1 is rotated obliquely by an oblique motor 160, and when a sensor 313 senses that the stapling mechanism has reached a prescribed oblique angle or a staple replacement position, the oblique motor 160 stops. After oblique stapling is finished or the replacement of staples is finished, the stapling mechanism is rotated to the original position to prepare for next stapling.

As shown in FIGS. 1 and 5, the center staplers S2 are arranged by two, fixed to a stay 63, and are arranged respectively at positions where the distance between the rear fences 51 and stapling positions of the center staplers S2 are not less than a distance corresponding to one-half of the length of the maximum sheet size that can be center stapled, as measured in the conveying direction, and are arranged symmetrically to each other with respect to the alignment center in the sheet width direction. In the case of center stapling, after a sheet stack is aligned by the jogger fences 53 in the direction perpendicular to the sheet conveying direction and is aligned in the sheet conveying direction by the rear fences 51 and the knock roller 12, the discharge belt 52 is driven to lift the back end portion of the sheet stack with its hook 52 to a position where the center portion of the sheet stack in the sheet conveying direction coincides with the stapling positions of the center staplers S2. The discharge belt 52 stops at this position and causes the center staplers S2 to staple the sheet stack. The stapled sheet stack is conveyed to the fold processing tray G side and is folded at the center.

In the drawings, a symbol 64*a* is a front side wall, 64*b* is a rear side wall, and a symbol 310 is a sheet sensor to sense the existence or non existence of the sheets on the staple tray F.

Figure 10:
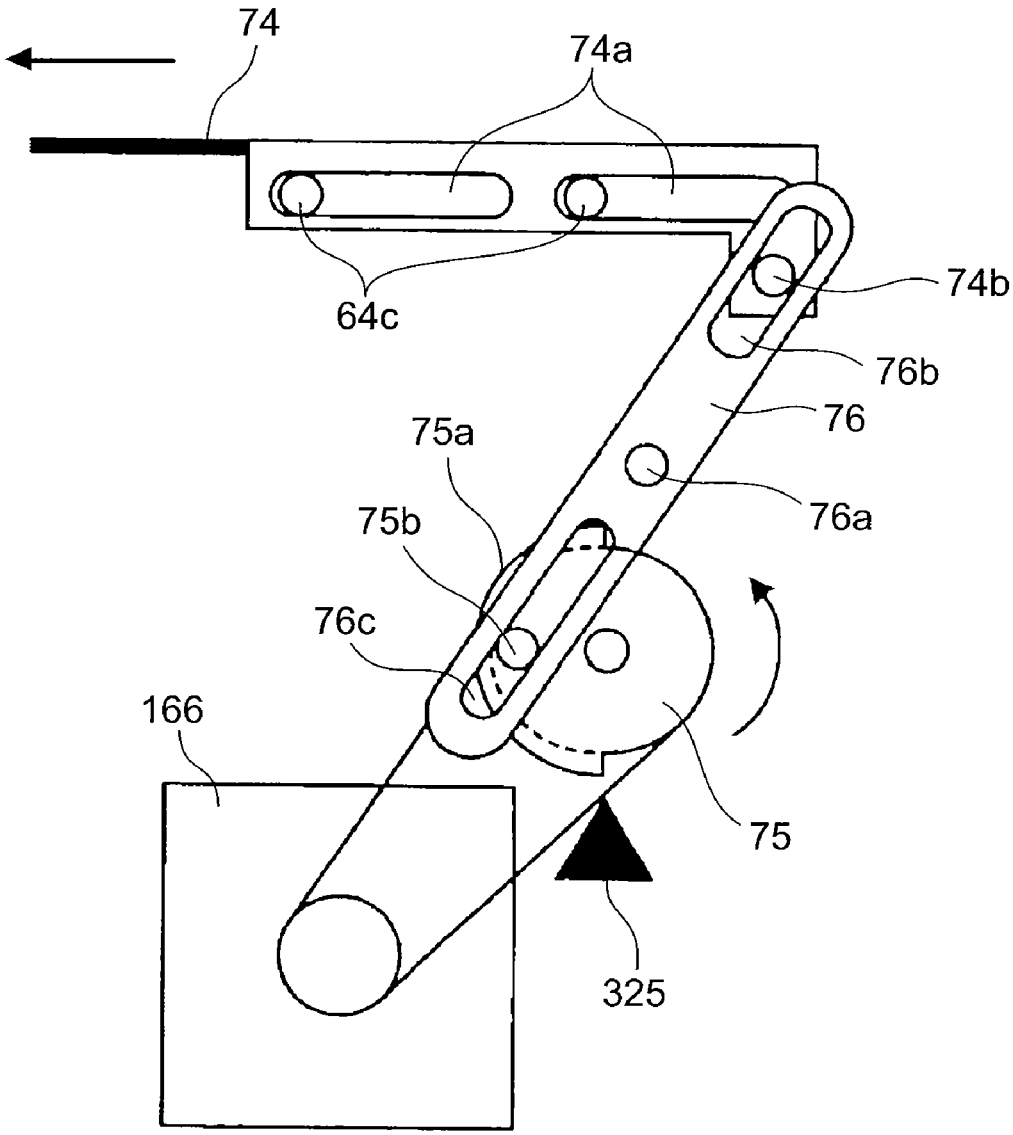
FIG. 10 is a view to describe an operation of a moving mechanism of a fold plate in the first embodiment, and shows a state before entering into a folding operation at the center.
Figure 11:
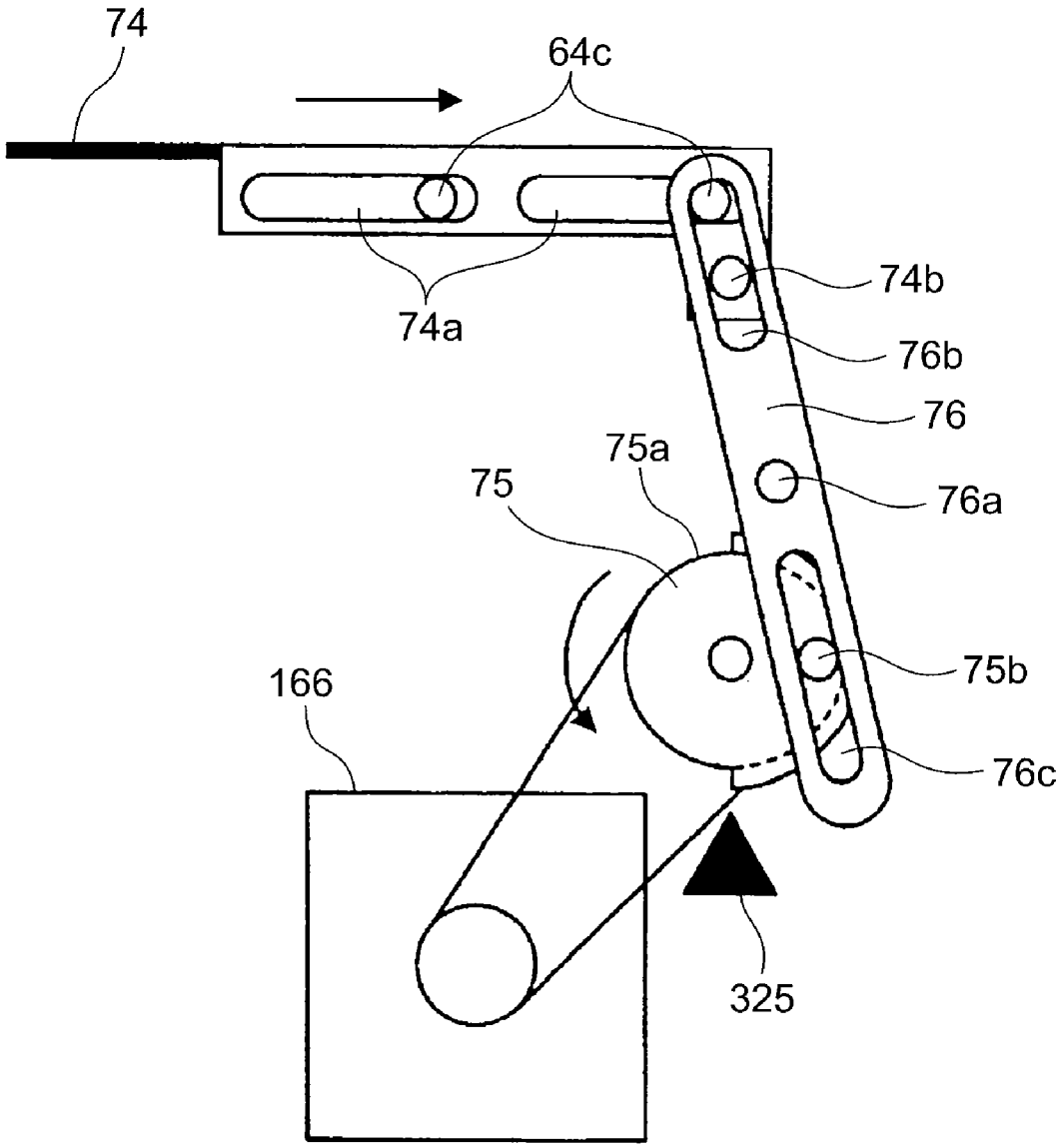
FIG. 11 is a view to describe an operation of the moving mechanism of the fold plate in the first embodiment, and shows a state to return to an original position after folding at the center.

FIG. 10 and FIG. 11 are views, each describing an operation of a moving mechanism of a fold plate 74 for center folding.

Figure 12:
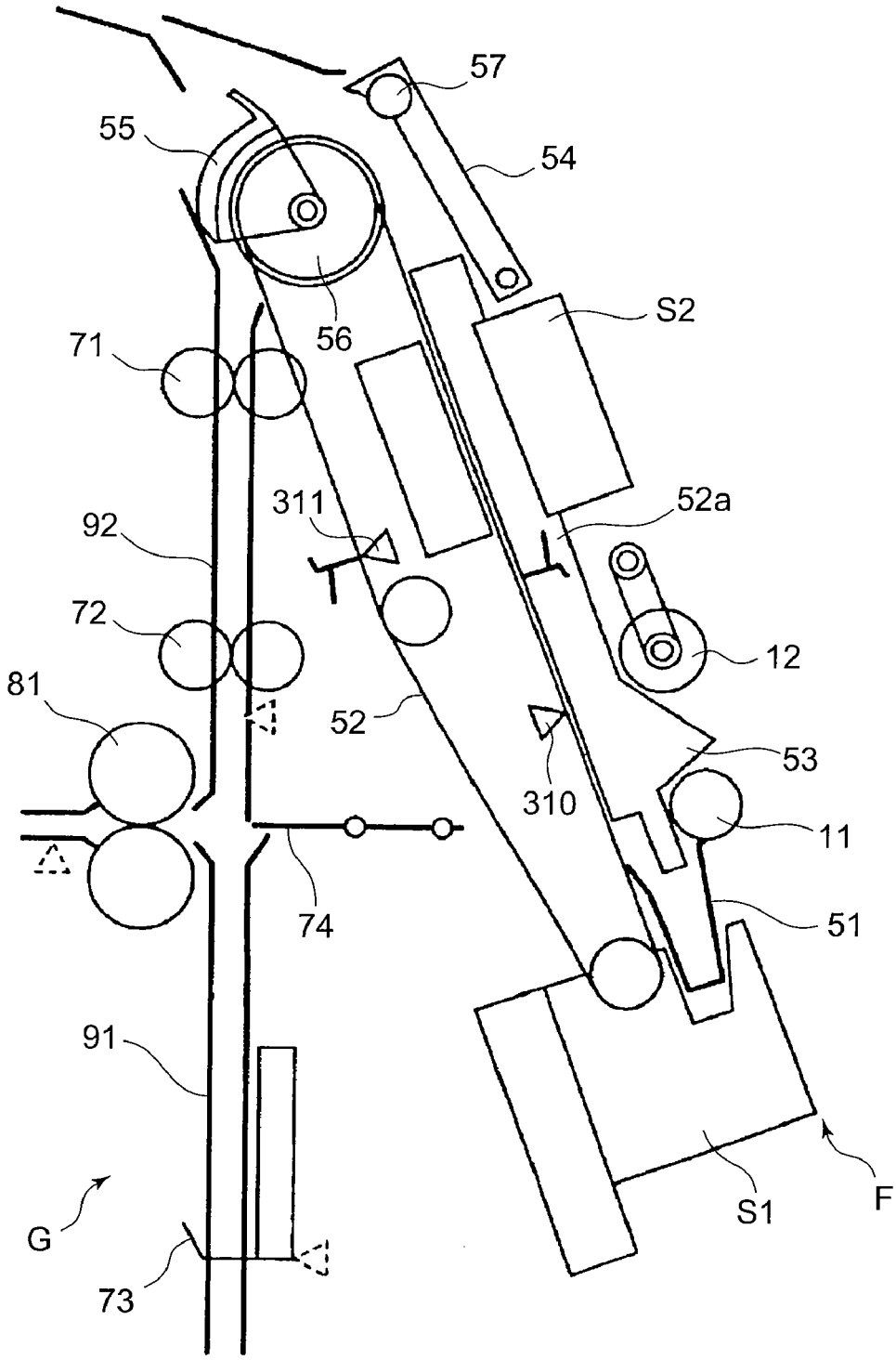
FIG. 12 is a view showing a staple processing tray and a fold processing tray in the first embodiment.

The fold plate 74 is supported in such a manner that each of elongate slots 74*a* formed in the fold plate 74 is movably received in one of two pins 64*c* studded on each of the front and rear side walls 64*a* and 64*b*. In addition, a pin 74*b* studded on the fold plate 74 is movably received in an elongate slot 76*b* formed in a link arm 76, and the link arm 76 swings about a fulcrum 76*a*, causing the fold plate 74 to move in the right-and-left direction in FIGS. 10 and 11. That is, a pin 75*b* studded on a fold plate cam 75 is movably received in an elongate slot 76*c* formed in the link arm 76, and the link arm 76 swings in accordance with the rotation movement of the fold plate cam 75, and in response to this movement, the fold plate 74 reciprocates in the direction perpendicular to a lower guide plate 91 and an upper guide plate 92 in FIG. 12.

The fold plate cam 75 is rotated in the direction of an arrow shown in FIG. 10 by a fold plate motor 166. The stop position of the fold plate cam 75 is determined by sensing both end portions of a semicircular interrupter portion 75*a* with a fold plate HP sensor 325.

FIG. 10 shows the position of the fold plate 74 in the home position where the fold plate 74 is fully retracted from the sheet stack housing range of the fold processing tray G. When the fold plate cam 75 is rotated in the direction of an arrow, the fold plate 74 is moved in the direction of the arrow and enters the sheet stack housing range of the fold processing tray G. FIG. 11 shows a position where the fold plate 74 pushes the center of the sheet stack on the fold tray G into the nip between the fold roller pair 81. When the fold plate cam 75 is rotated in the direction of an arrow, the fold plate 74 moves in the direction of the arrow and thereby retracts from the sheet stack housing range of the fold processing tray G.

In the first embodiment, with respect to center folding, to fold a sheet stack at the center is assumed, but the first embodiment is also applied to a case to fold a single sheet at the center. In such a case, because a single sheet does not have to be stapled at the center, at a time point when the sheet is discharged, the sheet is fed to the fold processing tray G side, folded by the fold plate 74 and the fold roller pair 81, and then discharged to the lower tray 203.

Next, the reinforce roller unit 400 will be described. As shown in FIG. 1, the reinforce roller unit 400 is provided on the path H between the fold roller pair 81 and an outlet roller pair 83. The sheet stack which has been folded by the fold plate 74 is pushed into the nip of the fold roller pair 81 and folded, and then the fold thereof is reinforced by the reinforce roller unit 400.

Figure 13:
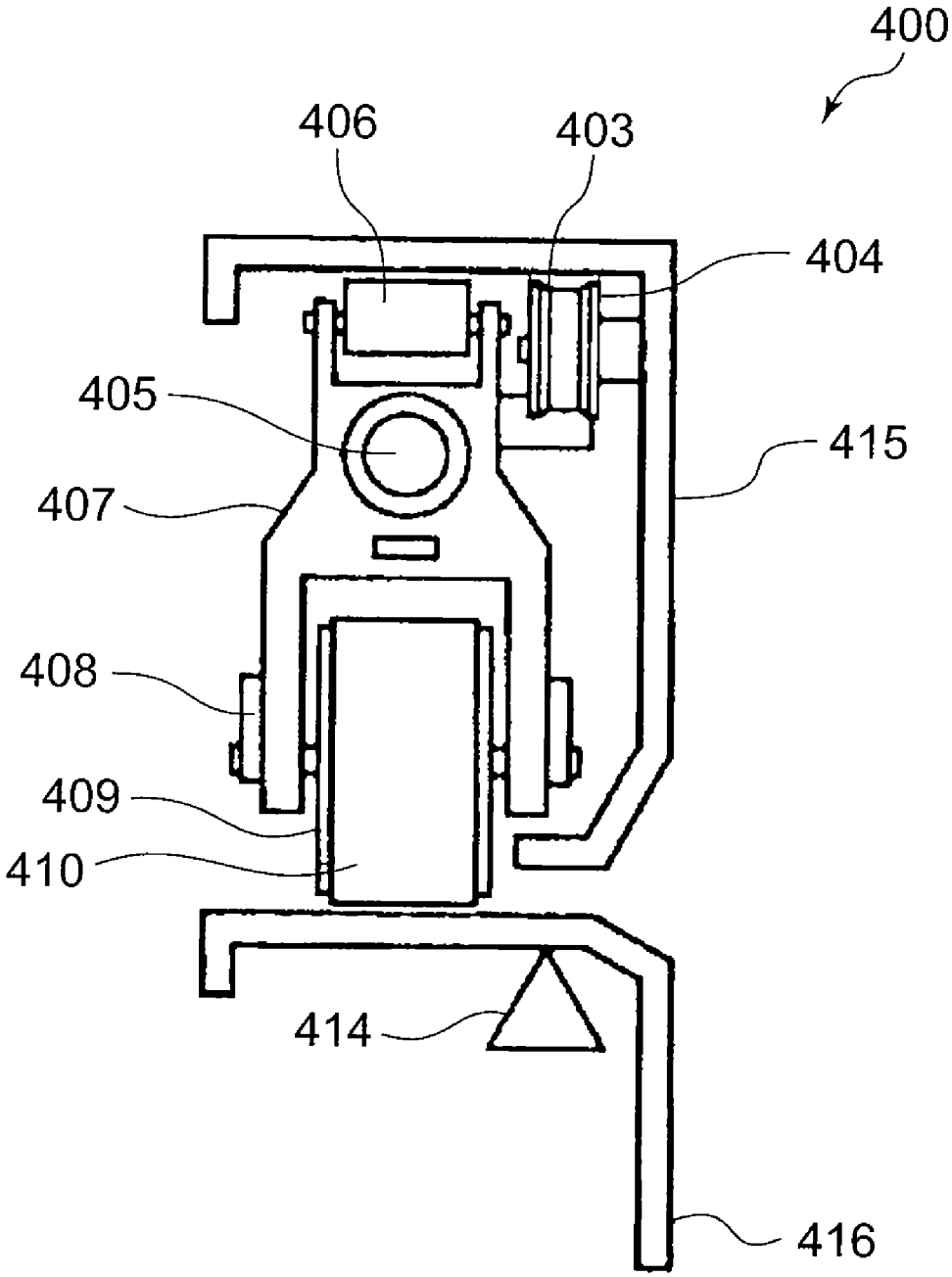
FIG. 13 is a front view of a reinforce roller unit in the first embodiment.
Figure 14:
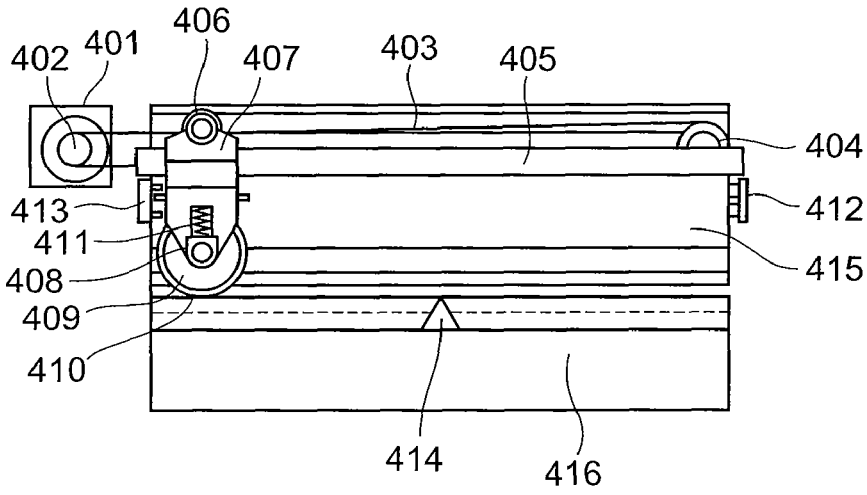
FIG. 14 is a side view of the reinforce roller unit in the first embodiment.

As shown in a plan view of FIG. 13 and a side view of FIG. 14, the reinforce roller unit 400 has a reinforce roller 409, a support mechanism of the reinforce roller 409, and a drive mechanism of the reinforce roller 409. The drive mechanism of the reinforce roller 409 includes a drive pulley 402, a driven pulley 404, an endless timing belt 403 which is passed over both the pulleys 402 and 404, and a pulse motor 401 for driving the timing belt 403 (FIG. 14) to rotate.

The support mechanism of the reinforce roller 409 includes a support portion 407 which is connected with and moves integrally with the timing belt 403, a guide portion 405 which the support portion 407 slides with and regulates the moving direction, an upper guide plate 415 which extends to the opposite side of the reinforce roller of the support portion 407, regulates the tilt of the reinforce roller 409, and prevents the guide portion 405 from bending, a roller support portion 408, a biasing member 411 (a coil spring in FIG. 14) as biasing means for biasing the reinforce roller 409 toward the folding direction of the sheet stack (downward in FIG. 13, FIG. 14). The support mechanism is arranged in the direction perpendicular to the sheet conveying direction, and the drive mechanism causes the reinforce roller 409 to move inside the support mechanism in the direction in which the support mechanism is arranged.

The rotation driving force of the pulse motor 401 is transferred to the support portion 407 connected with the timing belt 403, via the timing belt 403 which is passed over the drive pulley 402 and the driven pulley 404, and the support portion 407 is guided by the guide portion 405 and moves while sliding in the thrust direction of the guide member 405. A bend-preventing portion 406 is provided between the support portion 407 and the upper guide plate 415, and is rotatably supported to the support portion 407, and being roller-shaped, the bend-preventing portion 406 can move integrally with the support portion 407 in the axial direction of the guide portion 405. The reinforce roller 409 is arranged between the support portion 407 and a lower guide plate 416, and a friction portion 410 is fitted on the circumference of the reinforce roller 409. The reinforce roller 409 moves back and forth.

The rotation axis of reinforce roller 409 is supported by the roller support portion 408, and the roller support portion 408 is supported in such a manner as to be movable in the up-and-down direction in sliding contact with the support portion 407. In addition, the roller support portion 408 is pressurized from the support portion 407 toward the lower guide plate 416 by the biasing member 411. In this configuration, the reinforce roller 409 can move in the thrust direction of the guide portion 405, integrally with the support portion 407, and during this time, the reinforce roller 409 is constantly pressurized toward the lower guide plate 416 by the biasing member 411, and moves in the up-and-down direction. In addition, a position sensor 412 and a position sensor 413 are provided at opposite sides in the thrust direction of the guide portion 405, as sensing means for sensing the position of the support portion 407. In case that the support portion 407 is positioned at positions of the position sensor 412 and the position sensor 413, the position sensors 412, 413 sense the support portion 407, respectively. A sheet stack sensor 414 senses a sheet stack conveyed to the reinforce roller unit 400.

The position sensor 413 senses the home position of the reinforce roller 409. After the sheet stack is conveyed to the prescribed position and stops, the reinforce roller 409 is moved from the position of the position sensor 413 to that of the position sensor 412 to perform the reinforcing operation. In this time, the number of pulses is counted, and in case that the reinforce roller 409 is not sensed by the position sensor 412 after counting a prescribed number of the pulses, that an abnormality (lock of the mechanism, stop due to an insufficient driving torque, step-out of the motor) occurs during the movement of the reinforce roller 409 is judged.

When judged to be abnormal, the pulse motor 401 is reversely rotated so as to return the reinforce roller 409 in the direction of the position sensor 413. In this time, an occurrence of a jam is displayed on the display portion.

Figure 15:
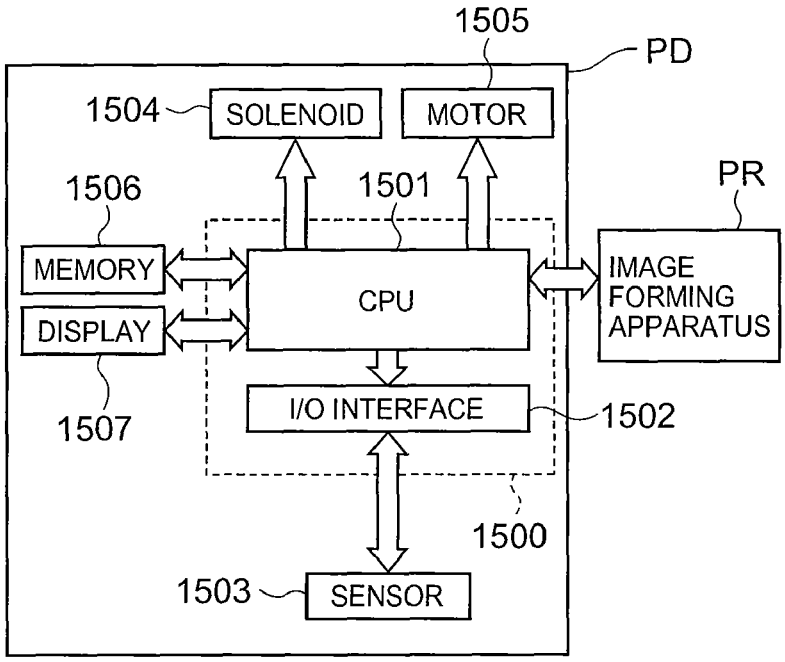
FIG. 15 is a block diagram showing a control of a sheet processing apparatus in the first embodiment.

FIG. 15 is a block diagram showing a control of the sheet processing apparatus. A control unit 1500 has a CPU 1501 and an I/O interface 1502. Signals from switches and so on of the control panel of the image forming apparatus PR and signals from sensors 1503 are inputted into the CPU 1500 via the I/O interface 1502. The CPU 1501 controls to drive a solenoid 1504 and a motor 1505 on the basis of the inputted signals.

Signals from the inlet sensor 301, the shift outlet sensor 303, the sheet surface sensor 330, the guide plate sensor 331, the sheet sensor 310, the HP sensor 311, the stapler HP sensor 312, the staple changing position sensor 313, the fold plate HP sensor 325, the position sensor 412, the position sensor 413 and the sheet stack sensor 414, for example, are inputted to the CPU 1501.

In order to control the finisher PD, the abnormality sensing control, and the display control for a display 1507, the CPU 1500 executes the program written in a memory 1506. In addition, a CPU provided in the image forming apparatus PR executes a display control for an operation and display unit in the image forming apparatus PR, in accordance with the control output of the CPU 1501.

Hereinafter, a series of flow will be described from the time of the occurrence of abnormality. Even if the pulse motor 401 is driven to cause the reinforce roller 409 to move in the direction of the position sensor 413, the position sensor 413 is not turned ON in a prescribed time, this state means that a jam is generated and an abnormality occurs. In this time, a display showing that a jam is generated is made on the operating portion of the image forming apparatus PR. In addition, the finisher PD may have the display 1507 to display that a jam is generated. Here, the term "jam" means to become in a state in which the reinforce roller 409 stops abnormally during the reinforcing operation by the reinforce roller 409 and the sheet can not be conveyed.

Figure 16:
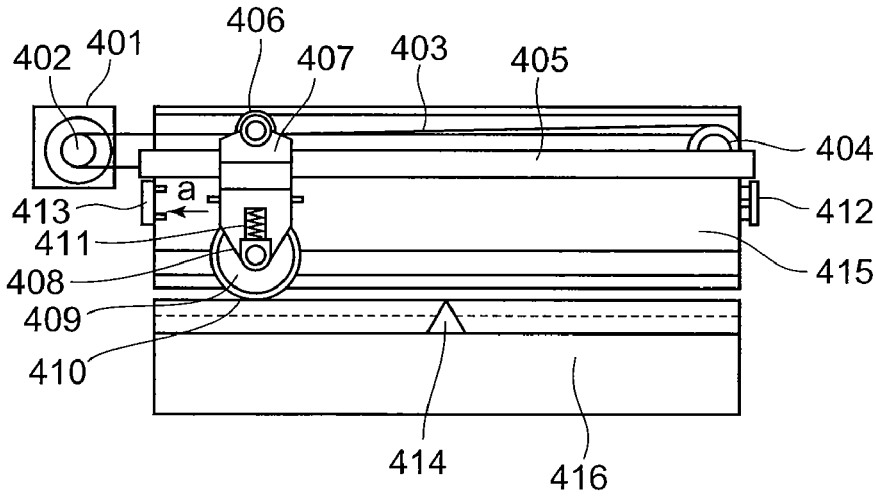
FIG. 16 is a view showing a reinforce roller to return a reinforced distance in the first embodiment.

FIG. 16 is a view showing the reinforce roller 409 to return the reinforced distance. The moving distance of the reinforce roller 409 in the direction perpendicular to the sheet conveying direction is judged by the count of the number of steps driven by the pulse motor 401, after the position sensor 412 and the position sensor 413 are turned OFF. If the reinforce roller 409 stops at the position shown in FIG. 16 at the time of the jam, the count of the number of steps after the position sensor 413 is turned OFF is not more than the number of steps of a half of the driven distance of the reinforce roller 409, and that the reinforce roller 409 is located at a position near the home position that is the retract position is judged.

When that the reinforce roller 409 is located at a position near the home position is judged, the reinforce roller 409 moves in the direction of an arrow a as shown in FIG. 16. The reinforce roller 409 moves to the outside of the width of the sheet during processing, and thereby returns to the home position as shown in FIG. 14. But even though the reinforce roller 409 is not located at the home position, the reinforce roller 409 may move to the outside of the width of the sheet during processing and thereby move to a retracting position.

Figure 17:
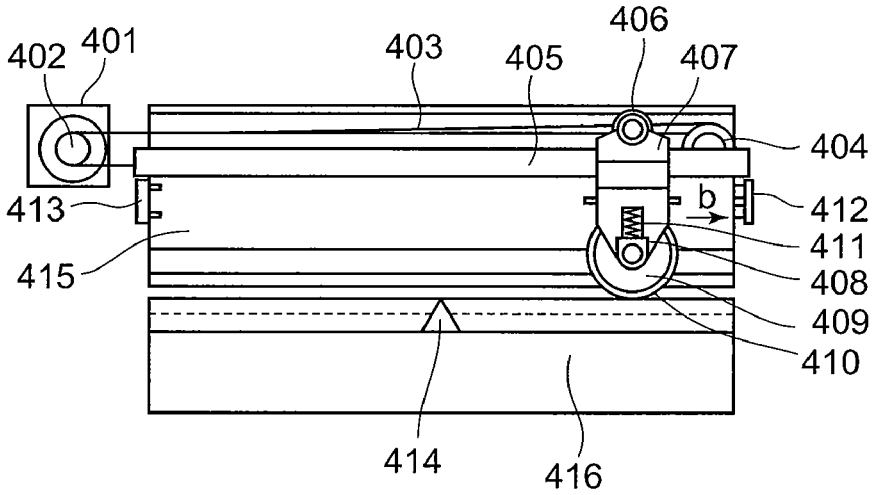
FIG. 17 is a view showing the reinforce roller to move a remaining distance to be reinforced in the first embodiment.

If the reinforce roller 409 stops at the position shown in FIG. 17 at the time of the jam, the count of the number of steps after the reinforce roller 409 returns and the position sensor 412 is turned OFF is not more than the number of steps of a half of the driven distance of the reinforce roller 409, and that the reinforce roller 409 is located at a position near the position (a return position) opposite to the home position is judged. In addition, even though the count of the number of steps after the position sensor 413 is turned OFF is not less than the number of steps of a half of the driven distance of the reinforce roller 409, that the reinforce roller 409 is located at a position near the position opposite to the home position is judged. The CPU 1501 executes the position judgment and control of the reinforce roller 409 based on the number of steps.

Figure 18:
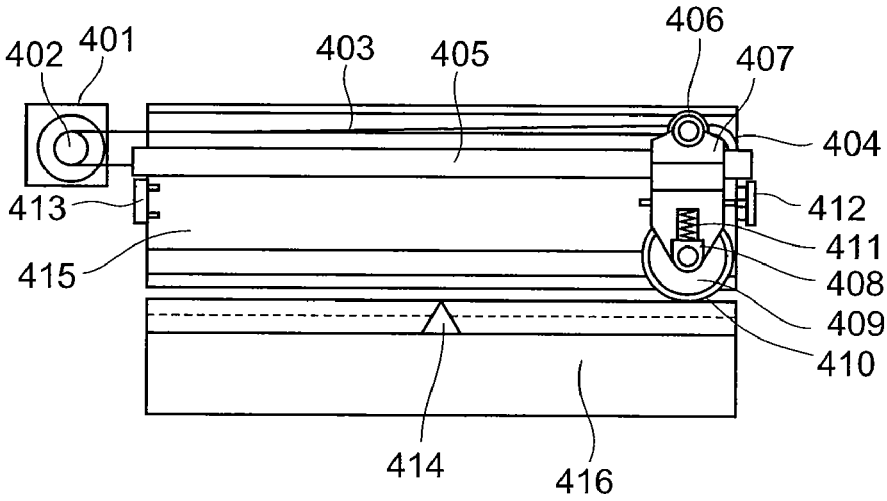
FIG. 18 is a view showing the reinforce roller located at a position opposite to a home position in the first embodiment.

When that the reinforce roller 409 is located at a position near the position opposite to the home position is judged, the reinforce roller 409 moves in the direction of an arrow b as shown in FIG. 17. The reinforce roller 409 moves to the outside of the width of the sheet during processing, and thereby moves to the position opposite to the home position as shown in FIG. 18. But even though the reinforce roller 409 is not located at the position opposite to the home position, the reinforce roller 409 may move to the outside of the width of the sheet during processing and thereby move to the retracting position. After the reinforce roller 409 is retracted, a user removes the sheet. After the jam is released, the reinforce roller 409 automatically returns to the home position.

The means for counting the moving distance is provided not only by counting the number of steps driven by the pulse motor 401 that is a distance sensing portion, but also the moving distance of the reinforce roller 409 may be counted by an encoder. For example, the drive pulley 402 or the driven pulley 404 may be provided with a rotary encoder to detect the moving distance, or the upper guide plate 415 may be provided with a linear encoder to detect the moving distance.

By sensing the moving distance, a distance to a first position and a distance to a second position for the sheet width respectively from the reinforce roller 409 which stops at the time of the jam can be sensed. If the distance to the first position is shorter than the distance to the second position for the sheet width, the reinforce roller 409 moves to the first position. On the other hand, if the distance to the second position is shorter than the distance to the first position for the sheet width, the reinforce roller 409 moves to the second position. The fist position is the home position and the second position is the position opposite to the home position, for example. However, the fist position may be the position opposite to the home position and the second position may be the home position.

With the above-described construction, the processing time to move the reinforce roller 409 to the retract position can be shortened.

Second Embodiment

In a second embodiment, in addition to the first embodiment, the lower guide plate 416 has a plurality of retract positions. The same symbols are given to the same constituent components as in the first embodiment.

Figure 19:
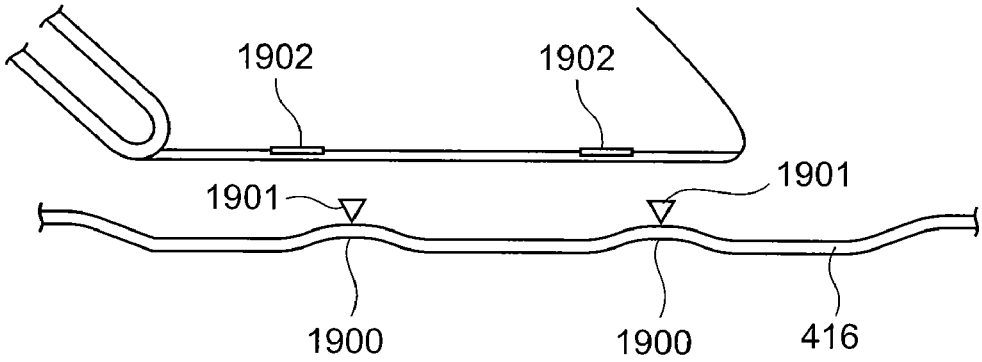
FIG. 19 is a view showing the lower guide plate having a plurality of retract positions in a second embodiment.

FIG. 19 is a view showing the lower guide plate 416 having a plurality of retract positions 1900 in the second embodiment. The lower guide plate 416 has two or more roller retract positions 1900 other than the home position. In FIG. 19, the lower guide plate 416 has two retract positions 1900 in addition to the home position and the position opposite to the home position. After an abnormality is sensed, the reinforce roller 409 moves to the nearest retract position. When the abnormality is sensed, the reinforce roller 409 preferably moves to the retract position locating in the direction reverse to its moving direction. But in case that the retract position 1900 is not present at the side opposite to the moving direction of the reinforce roller 409, the torque is raised to cause the reinforce roller 409 to move to the nearest retract position.

After confirming the jam at the reinforce roller 409 with the display screen of the display 1507, a user pushes a reinforce roller fixing release button. Then the lower guide plate 416 moves in the direction to separate from the reinforce roller 409, or the reinforce roller 409 moves in the direction to separate from the lower guide plate 416, and thereby the lower guide plate 416 and the reinforce roller 409 are released from their high pressure state. The solenoid is turned ON and OFF thereby to cause the lower guide plate 416 and the reinforce roller 409 to move. The solenoid is controlled by the control unit 1500.

In addition, position sensors 1901, 1901 are preferably provided at the retract positions 1900, 1900, respectively. In addition, the retract positions 1900, 1900 may be at stapling positions 1902, 1902, respectively.

With the above-described construction, the processing time to move the reinforce roller 409 to the retract position can be more shortened. In addition, by making the retract positions 1900 at the stapling positions 1902, respectively, the reinforce roller 409 can also be protected.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a fold roller pair to fold a sheet being pushed into a nip thereof, a reinforce roller to reinforce a fold of the sheet folded by the fold roller pair;

a support portion to move the reinforce roller in a direction perpendicular to a sheet conveying direction;

a sensor to sense a position of the support portion;

a distance sensing portion to sense a distance to a first position and a distance to a second position from a stop position of the support portion, when the sensor senses an abnormal stop of the support portion; and a control unit to compare the distance to the first position and the distance to the second position sensed by the distance sensing portion and to control the support portion to move in a direction where a moving distance is shorter.

2. The apparatus of claim 1, the first position being a home position, and the control unit controls the support portion to move to the home position when the control unit judges that the stop position of the support portion is nearer to the home position.

3. The apparatus of claim 1, the second position being a position opposite to a home position, and the control unit controls the support portion to move to the position opposite to the home when the control unit judges that the stop position of the support portion is nearer to the position opposite to the home position.

4. The apparatus of claim 2, two or more retract positions being provided in addition to the home position, and the control unit moves the support portion to the nearest retract position.

5. The apparatus of claim 4, the retract position including a sheet stapling position.

6. The apparatus of claim 4, a position sensor being provided at the retract position.

7. An image forming system, comprising:

a sheet processing apparatus including:

a fold roller pair to fold a sheet being pushed into a nip thereof;

a reinforce roller to reinforce a fold of the sheet folded by the fold roller pair;

a support portion to move the reinforce roller in a direction perpendicular to a sheet conveying direction;

a sensor to sense a position of the support portion;

a distance sensing portion to sense a distance to a first position and a distance to a second position from a stop position of the support portion, when the sensor senses an abnormal stop of the support portion; and a control unit to compare the distance to the first position and the distance to the second position sensed by the distance sensing portion and to control the support portion to move in a direction where a moving distance is shorter; and an image forming apparatus including:

an image forming unit to form an image on the sheet based on inputted image information; and a sheet feeding unit to feed the sheet to the image forming unit.

8. The system of claim 7, the first position being a home position, and the control unit controls the support portion to move to the home position when the control unit judges that the stop position of the support portion is nearer to the home position.

9. The system of claim 7, the second position being a position opposite to a home position, and the control unit controls the support portion to move to the position opposite to the home position when the control unit judges that the stop position of the support portion is nearer to the position opposite to the home position.

10. The system of claim 8, two or more retract positions being provided in addition to the home position, and the control unit moves the support portion to the nearest retract position.

11. The system of claim 10, the retract position including a sheet stapling position.

12. The system of claim 10, a position sensor being provided at the retract position.

13. A sheet processing method, comprising:

folding a sheet being pushed into a nip of a fold roller pair;

reinforcing a fold of the sheet folded by the fold roller pair by a reinforce roller;

supporting the reinforce roller with a support portion;

sensing a position of the support portion with a sensor;

sensing a distance to a first position and a distance to a second position from a stop position of the support portion with a distance sensing portion, when the sensor senses an abnormal stop of the support portion; and comparing the distance to the first position and the distance to the second position sensed by the distance sensing portion and controlling the support portion to move in a direction where a moving distance is shorter.

14. The method of claim 13, the first position being a home position, and the support portion is controlled to move to the home position when that the stop position of the support portion is nearer to the home position is judged.

15. The method of claim 13, the second position being a position opposite to a home position, and the support portion is controlled to move to the position opposite to the home position when that the stop position of the support portion is nearer to the position opposite to the home position is judged.

16. The method of claim 14, two or more retract positions being provided in addition to the home position, and the support portion being moved to the nearest retract position.

17. The method of claim 16, the retract position including a sheet stapling position.

18. The method of claim 16, a position sensor being provided at the retract position.

* * * * *